US011197534B2

(12) United States Patent
Bourque

(10) Patent No.: US 11,197,534 B2
(45) Date of Patent: Dec. 14, 2021

(54) MULTIPURPOSE HANDS-FREE CARRYING APPARATUS

(71) Applicant: Daniel Bourque, Quebec (CA)

(72) Inventor: Daniel Bourque, Quebec (CA)

( * ) Notice: Subject to any disclaimer, the term of this patent is extended or adjusted under 35 U.S.C. 154(b) by 0 days.

(21) Appl. No.: 16/865,801

(22) Filed: May 4, 2020

(65) Prior Publication Data

US 2021/0137251 A1 May 13, 2021

Related U.S. Application Data

(60) Provisional application No. 62/932,351, filed on Nov. 7, 2019.

(51) Int. Cl.
*A45F 5/02* (2006.01)
*E06C 7/00* (2006.01)

(52) U.S. Cl.
CPC . *A45F 5/02* (2013.01); *E06C 7/00* (2013.01)

(58) Field of Classification Search
CPC .... A45F 5/021; A45F 5/02; A45F 5/10; A45F 2003/144; A45F 3/14; A45F 5/102; B65G 7/12
See application file for complete search history.

(56) References Cited

U.S. PATENT DOCUMENTS 909,217 A 1/1909 Presba
3,285,482 A * 11/1966 Bedsaul, Sr. ..... A45F 5/02 224/268
5,452,830 A 9/1995 Hopkins
6,189,752 B1 * 2/2001 Perry ..... A45F 5/00 224/264
7,841,653 B2 * 11/2010 Sanchez ..... B60N 2/2845 297/183.3
8,783,534 B1 * 7/2014 Marshall ..... A45F 5/021 224/269
9,044,081 B2 * 6/2015 McDonald ..... A45F 3/14
9,162,090 B2 10/2015 Theisen
D812,905 S * 3/2018 Olsen ..... D3/254
(Continued)

FOREIGN PATENT DOCUMENTS

JP H106250 A 1/1998
KR 20100053039 A 5/2010

OTHER PUBLICATIONS

Ridgid Store, Pipe Wrench Hook Jaw, Amazon, Oct. 2008.

*Primary Examiner* — Corey N Skurdal

(57) ABSTRACT

A multipurpose hands-free carrying apparatus that includes a main body, an upper bracket, a lower bracket, a first support section, a second support section, and a retaining portion. The upper bracket curvingly extends from the main body. The lower bracket curvingly extends from the main body. The lower bracket is positioned proximate to the upper bracket. The lower bracket comprises an aperture. The first support section longitudinally extends from the main body. The second support section longitudinally extends from the main body opposite the first support section. The retaining portion extends from the main body opposite the upper bracket, is resiliently coupled to the main body. The retaining portion is also positioned proximate to the upper bracket opposite the lower bracket and configured to demountably couple the apparatus to a garment.

11 Claims, 5 Drawing Sheets

(56) References Cited

U.S. PATENT DOCUMENTS

| | | | | |
|---|---|---|---|---|
| 2005/0161479 | A1* | 7/2005 | Licsko | A45F 3/14 224/270 |
| 2006/0011681 | A1* | 1/2006 | Raimondo | A45F 5/02 224/268 |
| 2014/0231476 | A1* | 8/2014 | Davis | A45C 13/38 224/271 |

* cited by examiner

MULTIPURPOSE HANDS-FREE CARRYING APPARATUS

FIELD OF THE INVENTION

The present disclosure relates generally to a carrying apparatus. More specifically, the present disclosure describes a multipurpose hands-free carrying apparatus.

BACKGROUND OF THE INVENTION

A ladder is generally carried by a worker to and from a storage location or vehicle and the place where it is used. A ladder generally is constructed to have a pair of side rails connected by at least one rung. A ladder can be cumbersome and can be difficult to control when it is carried because it can swing or rise and fall in a variety of directions. If uncontrolled, this movement can injure the worker carrying the ladder. Uncontrolled, unpredictable movement of the ladder can also be dangerous to other people or property in the field of movement of the ladder.

A ladder may be carried either above or below the shoulder. If the ladder is carried above the shoulder, one of the side rails is placed on a carrier's or worker's shoulder with the remainder of the ladder, i.e., the rungs and the opposing side rail, above the carrier's or worker's shoulder. If the ladder is carried below the shoulder, one of the side rails is placed on a carrier's or worker's shoulder with the rungs and the opposing side rail located below the person's shoulder.

In either of the above-described carrying positions, the entire weight of the ladder is borne by the carrier's or worker's shoulder muscles and collarbone, which may cause substantial strain on that area of the body. Also, as the ladder side rail may assume a variety of configurations such as U-shaped or C-shaped, there may be increased discomfort due to uneven contacting of the rail with the carrier's or worker's shoulder area. For example, with U-shaped and C-shaped side rails the edges of the side rail contacts the body but the flat, center area of the side rail does not contact the body. That results in the weight and pressure of the ladder being supported by two narrow places on the carrier's shoulder.

The wrist may also experience strain as the carrier or worker attempts to control the ladder to prevent uncontrolled movements. Ladders can be difficult to balance when carried. If more of the ladder is carried behind the carrier or worker, he may try to compensate by pulling the ladder down in front of him, which can create a strain on his body. A comparable balancing problem can occur if more of the ladder is in front of the carrier or worker.

It can sometimes be difficult to determine the best or optimum support point for carrying a ladder, as it is dependent on the carrier or worker carrying the ladder and the terrain. Some carriers or workers contend the best support point for a ladder is at its center of balance or slightly ahead of its center of balance. At the center of balance, the carrier or worker can determine whether or not the ends of a ladder are moved up or down. If the support point is in front of the center of balance of the ladder, the front of the ladder will not fall and dig into the ground, which can injure the carrier or worker carrying the ladder. However, using this support position causes the back end of the ladder to touch the ground and scrape along as the carrier or worker moves forward, which can cause more uncontrolled movement of the ladder. Generally, the carrier or worker carrying the ladder does other physical work after putting the ladder in place, so that it is prudent to conserve his energy and strength. Various attempts have been made to alleviate the above-mentioned problems encountered in carrying ladders.

BRIEF DESCRIPTION OF THE DRAWINGS

Some of the embodiments will be described in detail, with reference to the following figures, wherein like designations denote like members, wherein.

Figure 1:
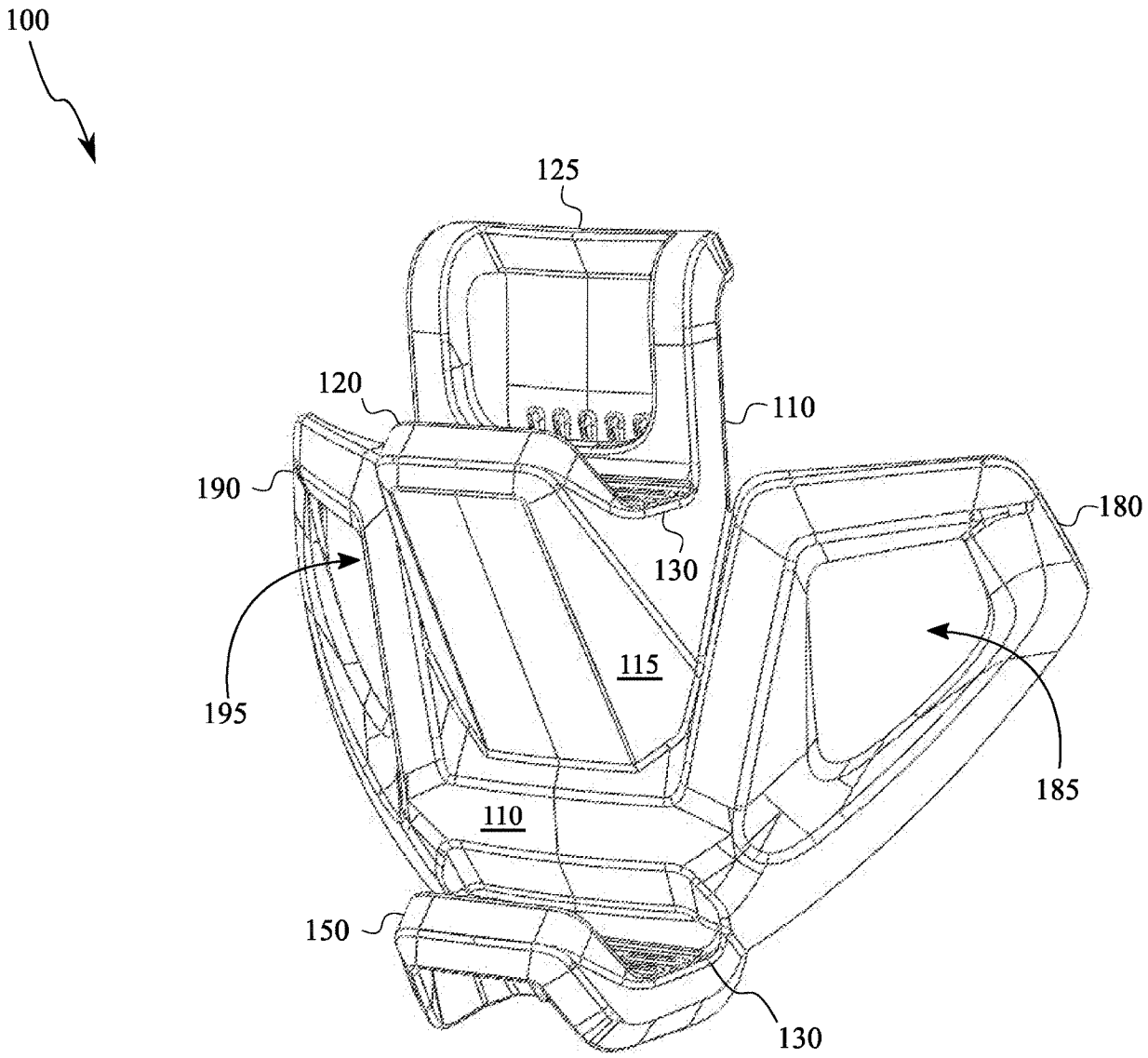
FIG. 1 illustrates a perspective view a multipurpose hands-free carrying apparatus ("the apparatus") according to some embodiments.

Unless otherwise specifically noted, articles depicted in the drawings are not necessarily drawn to scale.

DETAIL DESCRIPTIONS OF THE INVENTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or"

denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "dorsal" refers to positions that are located near, on, or towards the upper or top side of a structure.

A ladder is generally carried by a worker to and from a storage location or vehicle and the place where it is used. A ladder generally is constructed to have a pair of side rails connected by at least one rung. A ladder can be cumbersome and can be difficult to control when it is carried because it can oscillate in a variety of directions. If uncontrolled, this movement can injure the worker carrying the ladder. Uncontrolled, unpredictable movement of the ladder can also be dangerous to other people or property in the field of movement of the ladder.

A ladder may be carried either above or below the shoulder. If the ladder is carried above the shoulder, one of the side rails is placed on a carrier's or worker's shoulder with the remainder of the ladder, i.e., the rungs and the opposing side rail, above the carrier's or worker's shoulder. If the ladder is carried below the shoulder, one of the side rails is placed on a carrier's or worker's shoulder with the rungs and the opposing side rail located below the person's shoulder.

In either of the above-described carrying positions, the entire weight of the ladder is borne by the carrier's or worker's shoulder muscles and collarbone, which may cause substantial strain on that area of the body. Also, as the ladder side rail may assume a variety of configurations such as U-shaped or C-shaped, there may be increased discomfort due to uneven contacting of the rail with the carrier's or worker's shoulder area. For example, with U-shaped and C-shaped side rails the edges of the side rail contacts the body but the flat, center area of the side rail does not contact the body. That results in the weight and pressure of the ladder being supported by two narrow places on the carrier's shoulder.

The wrist may also experience strain as the carrier or worker attempts to control the ladder to prevent uncontrolled movements. Ladders can be difficult to balance when carried. If more of the ladder is carried behind the carrier or worker, he may try to compensate by pulling the ladder down in front of him, which can create a strain on his body. A comparable balancing problem can occur if more of the ladder is in front of the carrier or worker.

It can sometimes be difficult to determine the best or optimum support point for carrying a ladder, as it is dependent on the carrier or worker carrying the ladder and the terrain. Some carriers or workers contend the best support point for a ladder is at its center of balance or slightly ahead of its center of balance. At the center of balance, the carrier or worker can determine whether or not the ends of a ladder are moved up or down. If the support point is in front of the center of balance of the ladder, the front of the ladder will not fall and dig into the ground, which can injure the carrier or worker carrying the ladder.

However, using this support position causes the back end of the ladder to touch the ground and scrape along as the carrier or worker moves forward, which can cause more uncontrolled movement of the ladder. Generally, the carrier or worker carrying the ladder does other physical work after putting the ladder in place, so that it is prudent to conserve his energy and strength. Various attempts have been made to alleviate the above-mentioned problems encountered in carrying ladders.

The instant disclosure seeks to provide a multipurpose hands-free carrying apparatus configured to reduce discomfort experienced by arms and shoulders when carrying objects (e.g., ladders, tools, etc.) according to various embodiments. For example, the apparatus allows users to carry a ladder in a hands-free manner and thereby reduce any associated fatigue and/or discomfort typically experienced.

Figure 2:
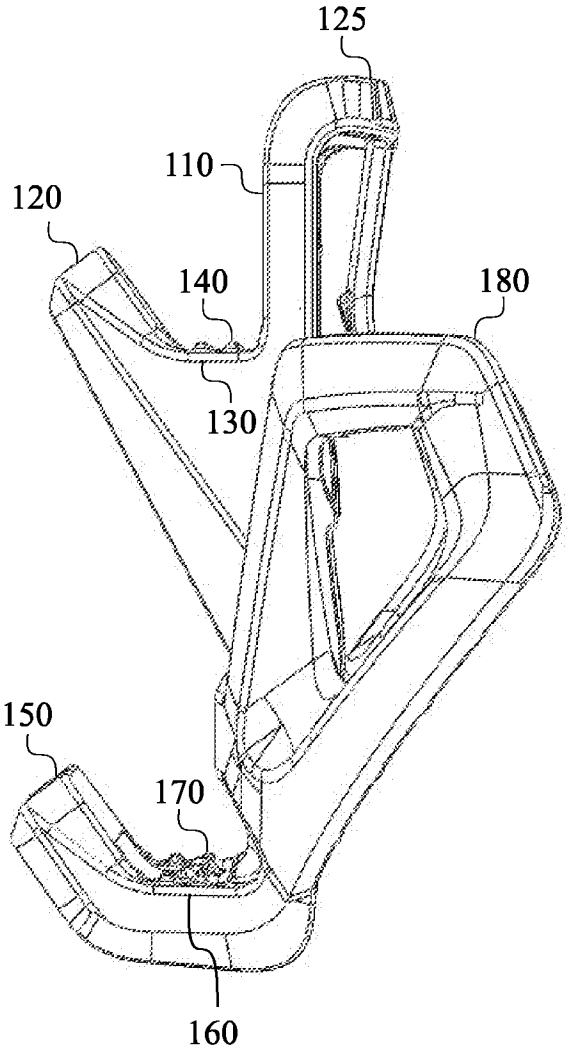
FIG. 2 illustrates left side view of the apparatus according to some embodiments.
Figure 3:
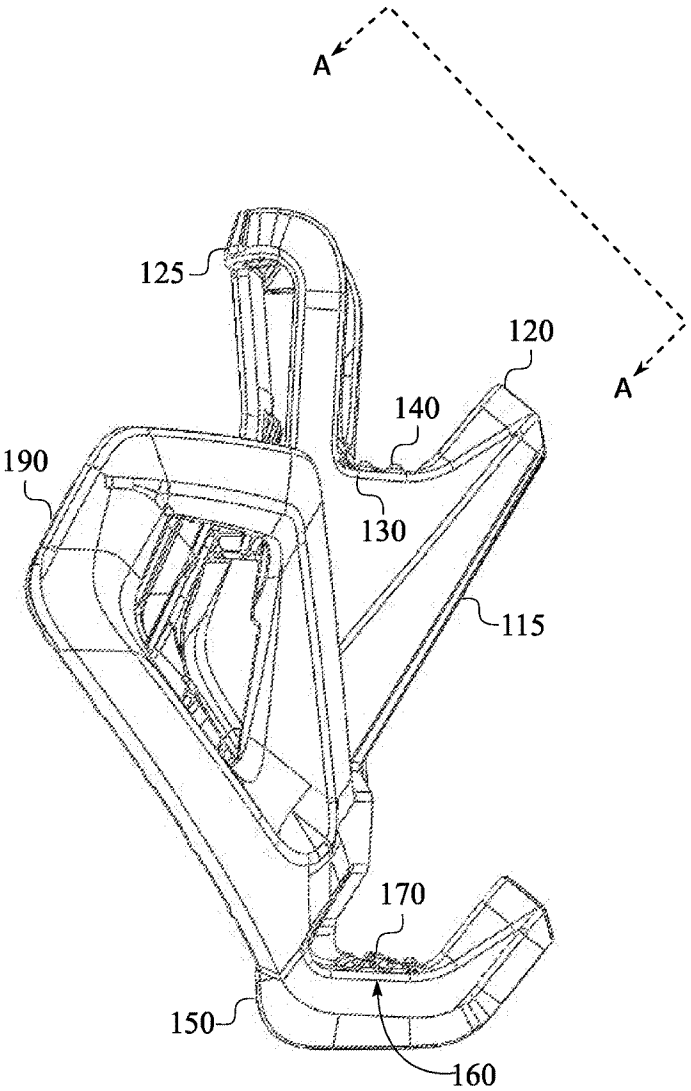
FIG. 3 illustrates right side view of the apparatus according to other embodiments.
Figure 4:
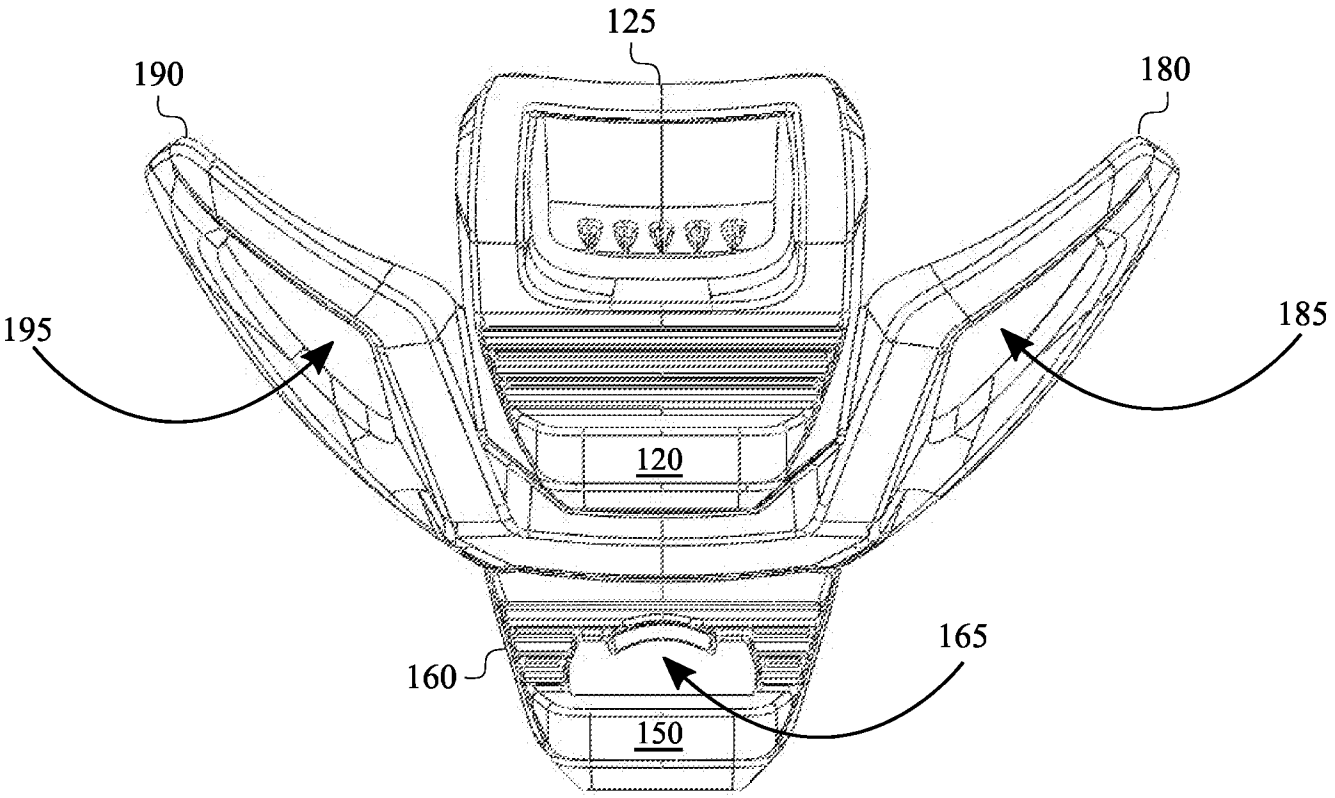
FIG. 4 illustrates View A of FIG. 3 according to certain embodiments.
Figure 5:
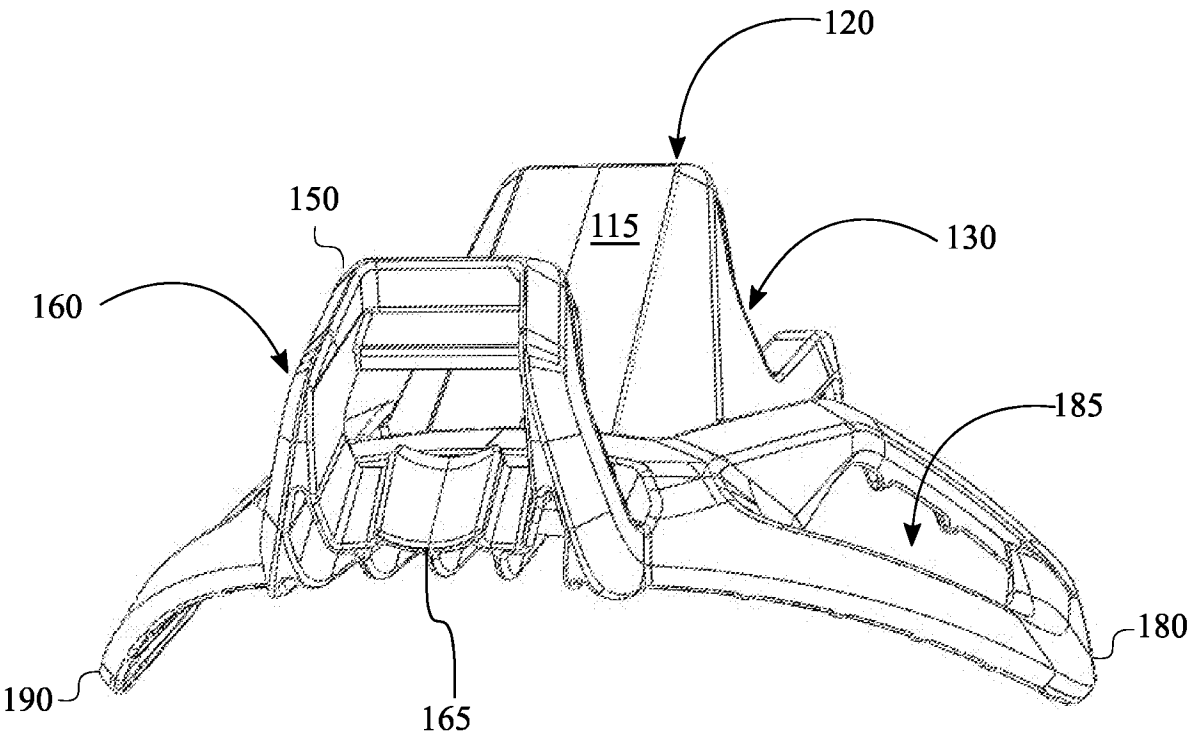
FIG. 5 illustrates bottom perspective view according to yet still others embodiments.

FIGS. 1-5 illustrate the multipurpose hands-free carrying apparatus (hereinafter "the apparatus"), generally 100, according to some embodiments. The FIGS. depict the apparatus 100 from various angles and merely seek to aid in the discussion and should not be interpreted as limiting in any manner. In other words, the FIGS. provided herein are for illustrative purposes only.

To begin, the apparatus 100 preferably includes main body 110, upper bracket 120, lower bracket 150, first support section 180, second support section 190, and retaining portion 125. The upper bracket 120 curvingly extends from the main body 110. For example, the upper bracket 120 has an overall structure that substantially curves away from the lower bracket 150. According to preferred embodiments, the upper bracket 120 is oriented perpendicular to the main body 110. The upper bracket 120 includes first receiving portion 130, which is configured to receive objects (e.g., ladders, tools, bags, etc.) for carrying. The first receiving portion includes one or more first ridge 140 that traverses the first receiving portion 115.

In some embodiments, the first ridge 140 is configured to grip objects positioned (e.g., resting) on the first receiving portion 115 and thereby reduce their movement within the upper bracket 120. For example, during transport, movement of objects supported (i.e. carried) by the upper bracket 120 can frustrate the user's ability to maintain their balance. The upper bracket 120 preferably extends further from the main body 110 compared to the lower bracket 150. A buttress 115 preferably angularly extends from the main body 110 and is positioned adjacent to the upper bracket 120. The buttress 115 is a structure that provides support for the upper bracket 120.

The lower bracket 150 curvingly extends from the main body 110. For example, the lower bracket 150 has an overall structure that substantially curves towards the upper bracket 120. According to preferred embodiments, the upper bracket 120 and the lower bracket 150 each has an overall structure that curves in the same direction. The lower bracket 150 is positioned proximate to the upper bracket 120. The lower bracket 150 and the upper bracket 120 are oriented in the same direction. According to preferred embodiments, the lower bracket 150 is oriented perpendicular to the main body 110. The lower bracket 150 includes second receiving portion 160, which is configured to receive objects (e.g., ladders, tools, bags, etc.) for carrying.

The second receiving portion 160 includes one or more second ridges 170 that traverses the second receiving portion 160. In preferred embodiments, the second ridges 170 is configured to grip objects and thereby reduce their movement within the lower bracket 150. For example, during transport, movement of objects supported (i.e. carried) by the lower bracket 150 can frustrate the user's ability to maintain their balance. In other words, the first ridges 140 and the second ridges 170 function in a similar manner. According to preferred embodiments, the lower bracket 150 includes an aperture 165 that traverses to the second receiving portion 160. The aperture 165 can have any shape that facilitates fulfillment of one or more embodiments discloses herein. However, the aperture 165 preferably has an overall shape that enables the removal of metal bottle caps from glass bottles (e.g., glass beer and/or soda bottles). For example, opening is performed with the use of a conventional pry off method.

The apparatus 100 preferably clips on to the garment (e.g., the waist band of trousers and shorts as well as belts) of the user. The retaining portion 125 is a resilient component that extends from the main body 110 opposite the upper bracket 120. The retaining portion 125 is preferably resiliently coupled to the main body 110, which, for example, allows the retaining portion 125 to press the garment against the main body 110 when the apparatus 100 is clipped on to the garment. In other words, the retaining portion 125 is configured to demountably couple the apparatus 100 to garments. The retaining portion 125 is preferably positioned proximate to the upper bracket 120 opposite the lower bracket 150.

According to preferred embodiments, the first support section 180 longitudinally extends from the main body 110. The first support member 180 curvingly extends from the main body 110 opposite the upper bracket 120 and the lower bracket 150. In other words, the first support member 180 is oriented opposite to the upper bracket 120 and the lower bracket 150. Similarly, the second support section 190 longitudinally extends from the main body 110. The second support member 190 curvingly extends from the main body 110 opposite the upper bracket 120 and the lower bracket 150. To be sure, the apparatus 100 is preferably worn approximate proximate to the user's upper thigh region while hanging from their waistband region. The first support member 180 and the second support member 190 together allow the apparatus 100 to move with the user's thigh. In other words, the apparatus 100 uses the first support member 180 and the second support member 190 to move with the user's thigh when in use.

In other words, both the first support member 180 and the second support member 190 are oriented opposite to the upper bracket 120 and the lower bracket 150. In some embodiments, the first support member 180 and the second support member 190 include a first void 185 and a second void 195, respectively. The first void 185 is preferably positioned centrally on the first support section 180 and traverses therethrough. The second void 195 is preferably positioned centrally on the second support section 190 and traverses therethrough. Not to be limited by theory, the first void 185 and the second void 195 together reduce the overall weight of the apparatus 100, which can potentially reduce discomfort experienced from transporting objects using the apparatus 100.

Although the disclosure has been explained in relation to its preferred embodiment, it is to be understood that many other possible modifications and variations can be made without departing from the spirit and scope of the disclosure.

What is claimed is:

1. A multipurpose hands-free carrying apparatus, comprising:
- a main body;
- an upper bracket;
- a lower bracket;
- a first support member;
- a second support member;
- a retaining portion;
- wherein
  - the upper bracket curvingly extends from the main body;
  - the lower bracket curvingly extends from the main body;
  - the lower bracket is positioned proximate to the upper bracket;
  - the lower bracket comprises an aperture;
  - the first support member
    - longitudinally extends from the main body;
    - curvingly extends from the main body opposite the upper bracket and the lower bracket; and
    - comprises a first void;
  - the second support member
    - longitudinally extends from the main body opposite the first support member;
    - curvingly extends from the main body opposite the upper bracket and the lower bracket; and
    - comprises a second void;
  - the retaining portion
    - extends from the main body opposite the upper bracket;
    - is resiliently coupled to the main body;
    - is positioned proximate to the upper bracket opposite the lower bracket; and
    - is configured to demountably couple the apparatus to a garment.

2. The apparatus of claim 1, wherein
- the upper bracket
  - is oriented perpendicular to the main body; and
  - comprises a first receiving portion.

3. The apparatus of claim 2, wherein
- the first receiving portion comprises a first ridge; and
- the first ridge traverses the first receiving portion.

4. The apparatus of claim 3, wherein
the lower bracket
is oriented perpendicular to the main body;
comprises a second receiving portion; and
the aperture traverses the second receiving portion.

5. The apparatus of claim 4, wherein
the second receiving portion comprises a second ridge; and
the second ridge traverses the second receiving portion.

6. The apparatus of claim 1, wherein the retaining portion is configured to press the garment against the main body and thereby demountably couple the apparatus to a garment.

7. A multipurpose hands-free carrying apparatus, comprising:
a main body;
an upper bracket;
a lower bracket;
a first support member;
a second support member;
a retaining portion;
wherein
the upper bracket
curvingly extends from the main body;
is oriented perpendicular to the main body;
comprises a first receiving portion;
the lower bracket curvingly extends from the main body;
the lower bracket is positioned proximate to the upper bracket;
the lower bracket comprises an aperture;
the first support member
longitudinally extends from the main body;
curvingly extends from the main body opposite the upper bracket and the lower bracket; and
comprises a first void;
the second support member
longitudinally extends from the main body opposite the first support member;
curvingly extends from the main body opposite the upper bracket and the lower bracket; and
comprises a second void;
the retaining portion
extends from the main body opposite the upper bracket;
is resiliently coupled to the main body;
is positioned proximate to the upper bracket opposite the lower bracket; and
is configured to press a garment against the main body and thereby demountably couple the apparatus to the garment.

8. The apparatus of claim 7, wherein
the first receiving portion comprises a first ridge; and
the first ridge traverses the first receiving portion.

9. The apparatus of claim 8, wherein
the lower bracket
is oriented perpendicular to the main body;
comprises a second receiving portion; and
the aperture traverses the second receiving portion.

10. The apparatus of claim 9, wherein
the second receiving portion comprises a second ridge; and
the second ridge traverses the second receiving portion.

11. A multipurpose hands-free carrying apparatus, comprising:
a main body;
an upper bracket;
a lower bracket;
a first support member;
a second support member;
a retaining portion;
wherein
the upper bracket
curvingly extends from the main body;
is oriented perpendicular to the main body;
comprises a first receiving portion;
the lower bracket
curvingly extends from the main body;
is positioned proximate to the upper bracket;
is oriented perpendicular to the main body;
comprises a second receiving portion;
comprises an aperture;
the first support member
longitudinally extends from the main body;
curvingly extends from the main body opposite the upper bracket and the lower bracket; and
comprises a first void;
the second support member
longitudinally extends from the main body opposite the first support member;
curvingly extends from the main body opposite the upper bracket and the lower bracket; and
comprises a second void;
the retaining portion
extends from the main body opposite the upper bracket;
is resiliently coupled to the main body;
is positioned proximate to the upper bracket opposite the lower bracket; and
is configured to demountably couple the apparatus to a garment.

* * * * *